US011547185B2

(12) United States Patent
Elinski

(10) Patent No.: US 11,547,185 B2
(45) Date of Patent: Jan. 10, 2023

(54) LOCKING RING

(71) Applicant: Creighton Elinski, Salt Lake City, UT (US)

(72) Inventor: Creighton Elinski, Salt Lake City, UT (US)

( * ) Notice: Subject to any disclaimer, the term of this patent is extended or adjusted under 35 U.S.C. 154(b) by 52 days.

(21) Appl. No.: 17/148,532

(22) Filed: Jan. 13, 2021

(65) Prior Publication Data

US 2022/0218077 A1 Jul. 14, 2022

(51) Int. Cl.
*A44C 9/00* (2006.01)
*A44C 13/00* (2006.01)

(52) U.S. Cl.
CPC ..... *A44C 9/00* (2013.01); *A44C 13/00* (2013.01)

(58) Field of Classification Search
CPC ... A44C 5/0084; A44C 5/0092; A44C 9/0038; A44C 9/0046; A44C 9/0023
USPC ..... 63/15.7
See application file for complete search history.

(56) References Cited

U.S. PATENT DOCUMENTS 3,127,757 A * 4/1964 Weiss ..... A44C 9/00 63/15.7
3,263,444 A * 8/1966 Di Corce ..... A44C 9/0038 63/15.7
3,619,913 A * 11/1971 Albrecht ..... A44C 9/0038 434/386
2019/0166962 A1* 6/2019 Stephens ..... A44C 9/0038
2020/0390203 A1* 12/2020 Sana ..... A44C 5/0092

* cited by examiner

*Primary Examiner* — Jack W Lavinder
(74) *Attorney, Agent, or Firm* — Amy Fiene; James Sonntag

(57) ABSTRACT

A locking ring includes a first annular band portion and a second annular band portion. The locking ring includes a first and second cutout on at least one end of the respective first and second semi-annular band portions. The ring configuration is made by bringing the first and second semi-annular band portions together. A key member is to be inserted within the first and second cutout to thereby lock the first and second annular band portions into a ring configuration to be worn on a finger. The key member is to be released when the ring configuration is under a threshold pressure to thereby allow the first and second semi-annular band portions to be unlocked.

19 Claims, 8 Drawing Sheets

LOCKING RING

BACKGROUND

Finger rings include round bands that may be worn as engagement rings, wedding bands, ornamental jewelry, or other purposes. Finger rings may be made of various materials and have various tensile strengths and shear strengths.

BRIEF DESCRIPTION OF THE DRAWINGS

The accompanying drawings illustrate various implementations of the principles described herein and are a part of the specification. The illustrated implementations are merely examples and do not limit the scope of the claims.

Throughout the drawings, identical reference numbers designate similar, but not necessarily identical, elements.

DETAILED DESCRIPTION

A ring may be made to break or otherwise become separated upon impact and applied pressure. The following relates to a ring having at least one key member that serves as the weakest link and that can break under force or pressure and thereby allow the ring to become separated or otherwise become loose. While reference is made to a ring, application of the invention pertains to other ring-like members, including bracelets, earrings, and other accessories.

An example of a locking ring includes a first annular band portion and a second annular band portion. The locking ring includes a first and second cutout on at least one end of the respective first and second annular band portions. The ring configuration is made by bringing the first and second annular band portions together. A key member is to be inserted within the first and second cutout to thereby lock the first and second annular band portions into a ring configuration to be worn on a finger. The key member is to be released when the ring configuration is under a force to thereby allow the first and second annular band portions to be unlocked.

Another example of a locking ring includes a circular band configured to be worn on a finger. A cutout in the band extends at least partially within a depth of the band. A key member is to be inserted within the cutout, the key member to be released when the ring configuration experiences a threshold force.

Another example of a locking ring includes a first annular band portion and a second annular band portion. The first and second annular band portions are symmetrical to each other. A first and second cutout is located on each end of the respective first and second annular band portions. Contact and alignment of the first and second annular band portions form the ring configuration. The alignment brings the first and second cutouts together to define bowtie shapes located on diametrically opposing sides of the ring configuration. A key member is inserted within each of the first and second cutouts to thereby lock the first and second annular band portions into the ring configuration. The key member comprises a material that breaks under less force than the first and second annular band portions, the force to thereby allow the first and second annular band portions to be unlocked.

The release of a finger from the ring configuration is advantageous, for example, when a finger gets caught in moving machinery or a heavy object. Also, the key member of the ring absorbs impact that would otherwise be transmitted to a finger through the annular band portions of the ring.

Figure 1:
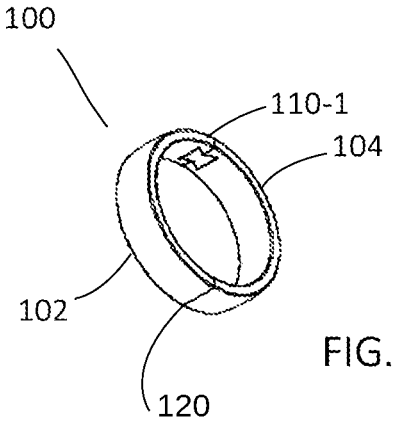
FIG. 1 is a perspective view of a locking ring.

Turning to FIG. 1, a perspective view is shown of a locking ring 100. The locking ring 100 includes a first 102 and second annular band portion 104. Each first 102 and second band portion 104 includes an arcuate, curved, or otherwise rounded section, and may be of a same or different circumferential length, dimension, and size from each other. Inner and outer surfaces may be smooth. In another example, at least one surface is textured, roughened, or coated with a material.

Figure 2:
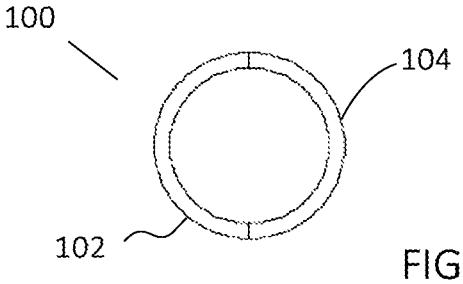
FIG. 2 is a side view of a locking ring.

FIG. 2 illustrates a side view of the locking ring configuration. Each first 102 and second annular band portion 104 comes together at ends to form a circular band with a slit or cut 120 where the ends come together. As shown, each band portion 102, 104 includes a half circle shape and thus the two band portions 102, 014 are symmetrical to each other. Each free end of the band portions 102, 104 includes a flat, perpendicular surface that lays flush when the band portions 102, 104 are in contact with each other in the locking ring configuration. Note that each band portion 102, 104 may have a different arc length and different curvature with respect to each other.

Figure 3:
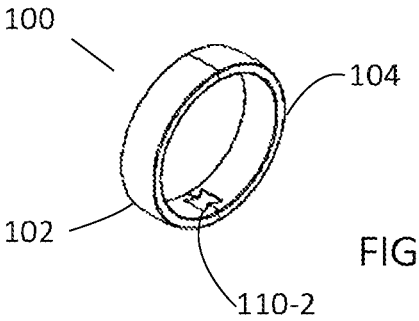
FIG. 3 is a perspective view of a locking ring.

FIG. 1 shows a perspective view of the ring 100 with key member 110-1 visible. FIG. 3 illustrates a perspective view of the ring 100 on an opposite facing side as key member 110-1, and thus key member 110-2 is visible in this view. Note that each key member 110-1, -2 lays flush with the inner surface of the first 102 and second annular band portions 104 in the ring 100 configuration.

While reference is made throughout the description to two key members 110-1, -2, examples include only a single a key member or multiple key members. For example, the first 102 and second annular band portions 104 may be attached on first ends by a hinge or other locking mechanism. On second ends, the first 102 and second annular band portions 104 may include cutouts that define a bowtie shape in which a key member 110 (see FIG. 10) is inserted. The key member 110 is the weakest link that breaks first upon impact, applied force, or pressure.

Outer ends of each band portion 102, 104 are flat so that they lay flush together when band portions 102, 104 are attached together. Outer ends further include cutouts 108-1, -2, -3, -4 (see FIGS. 7 and 9) which are recessed regions that extend at least partly through the depth of the band portion 102, 104. The cutouts 108-1, -2, -3, -4 are configured for key members 110-1, -2 to be placed inside with a friction fit or otherwise secure manner. The bottom facing surfaces of the key members 110-1, -2 are to contact corresponding top facing surface of the cutouts 108-1, -2, -3, -4 in the secured ring configuration. Also, sidewalls of the key members 110-1, -2 are to contact corresponding sidewalls of the cutouts 108-1, -2, -3, -4.

The cutouts 108-1, -2, -3, -4 may extend equal depths or different depths in the material of the respective first 102 and second band portions 104. The cutouts 108-1, -2, -3, -4 may be provided by material being omitted or material that is carved out or otherwise removed from the outer ends of the band portions 102, 104. Each cutout 108-1, -2, -3, -4 may be a same or different shape. As shown, cutouts 108-1, -2, -3, -4 are the same such that when ends of band portions 102, 104 are put together, cuts or slits 120 are formed, and the cutouts 108-1, -2, -3, -4 define a shape that is symmetrical along a centerline or transverse axis of the ring 100, such as an axis that is perpendicular to a central axis of the circular band. The cutouts 108-1, -2, -3, -4 may also be described as being symmetrical about the line formed by the cut or slit 120 where ends are meeting flush together.

In another example, the cutouts 108-1, -2, -3, -4 are asymmetrical, defining a bow tie shape that is positioned off center from the line formed by ends of the first 102 and second semi-annular band portions 104. In another example, the cutouts 108-1, -2, -3, -4 comprise different shapes from each other. For example, at least one cutout of the cutouts 108-1-2, -3, -4 may comprise a shape that is not a half bowtie shape, such as a half circle or half arrow shape. Other half shapes or shapes are anticipated for at least one of the cutouts 108-1, -2, -3, -4.

Figure 4:
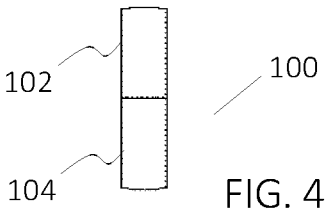
FIG. 4 is a top view of a locking ring.
Figure 5:
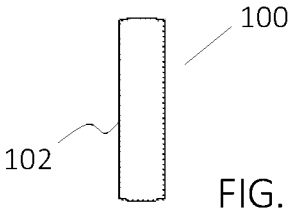
FIG. 5 is a side view of a locking ring.
Figure 6:
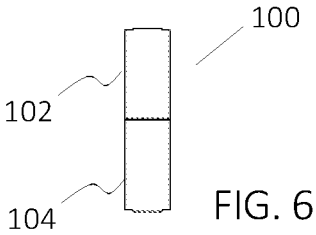
FIG. 6 is a bottom view of a locking ring.

FIG. 4 shows a top view of the locking ring 100, clearly showing a flush contact between the two band portions 102, 104. This view is mirrored with a flush contact also being present in the bottom view of the locking ring 100, as shown in FIG. 6. FIG. 5 shows a side view of the locking ring 100, the ends of the first 102 and second band portions 104 secured together and two half circle shapes of the first 102 and second band portions 104 brought together.

Figure 7:
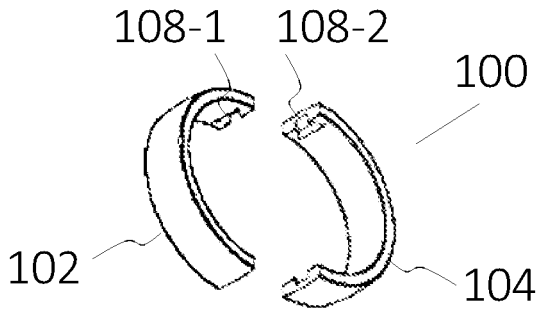
FIG. 7 is an exploded perspective view of a locking ring without a key member.
Figure 8:
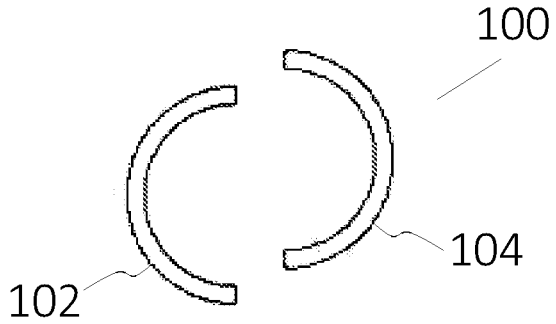
FIG. 8 is an exploded side view of a locking ring without a key member.
Figure 9:
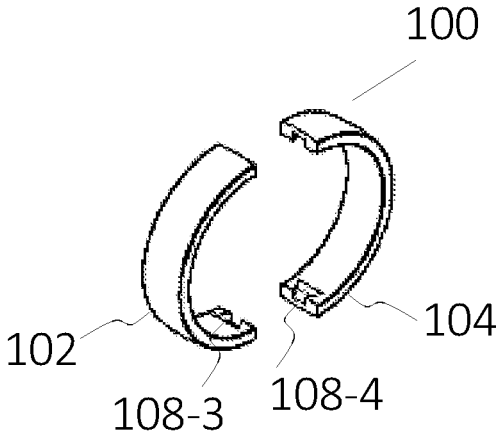
FIG. 9 is an exploded perspective view of a locking ring without a key member.

FIG. 7 illustrates an exploded perspective view of the first 102 and second semi-annular band portions 104 without a key member 110-1, -2 present. The cutouts 108-1, -2 on ends of each band portion 102, 104 are referenced. FIG. 9 illustrates the exploded perspective view from another angle with opposing cutouts 108-2, -4 of each band portion 102, 104 being referenced. FIG. 8 illustrates a side view of each first 102 and second semi-annular band 104 without a key member 110-1, -2.

As shown, ends of the cutouts 108-1, -2, -3, -4 are wider than a central location of the cutouts 108-1, -2, -3, -4. The cutouts are angled indentations that taper outward from the free ends of the respective band portions 102, 104. The edges of the first 102 and second semi-annular bands 104 meet flush together to form the circular band.

The cutouts 108-1, -2, -3, -4 may have a depth that is less than half, half, or more than half the depth of the first 102 and second semi-annular bands 104. In an example, the cutouts 108-1, -2, -3, -4 extend all the way through the first 102 and second semi-annular bands 104. In another example, the cutouts 108-1, -2, -3, -4 extend different depths from each other. For example, cutout 108-1, may extend partially through the first band 102 while cutout 108-2 extends all the way through the second band 104. In an example, the cutouts 108-1, -2, -3, -4 each have a depth that is less than a length of the key members 110-1, -2. In another example, the cutouts 108-1, -2, -3, -4 each have a depth that is equal to or greater than a length of the key members 110-1, -2.

Figure 10:
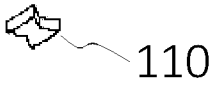
FIG. 10 is a perspective view of a key member.
Figure 12:
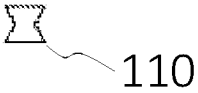
FIG. 12 is a front view of a key member.
Figure 11:
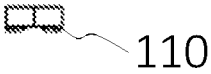
FIG. 11 is a side view of a key member.
Figure 13:
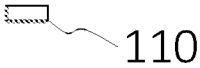
FIG. 13 is a top view of a key member.

A key member 110 is shown in FIGS. 10, 11, 12, 13. It represents the key members 110-1, -2 shown in previous figures, but for simplicity as being shown as a single member, it is referenced as 110. FIG. 10 illustrates a perspective view, FIG. 11 illustrates a side view, FIG. 12 illustrates a front view, and FIG. 13 illustrates a top view. As shown, the key member 110 includes a bowtie shaped element to fit within the bowtie shape cutout formed by first and second cutouts of semi-annular band portions. The key member 110 has a thickness that corresponds to the depth of the bowtie shaped cutout. The bowtie shape holds the first 102 and second 104 semi-annular band portions together in a ring configuration against pulling and pushing forces.

Figure 14:
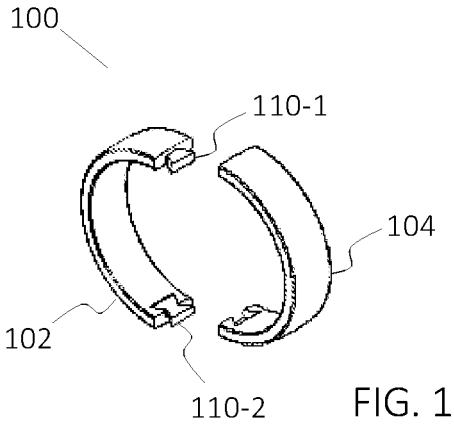
FIG. 14 is an exploded perspective view of a locking ring.
Figure 15:
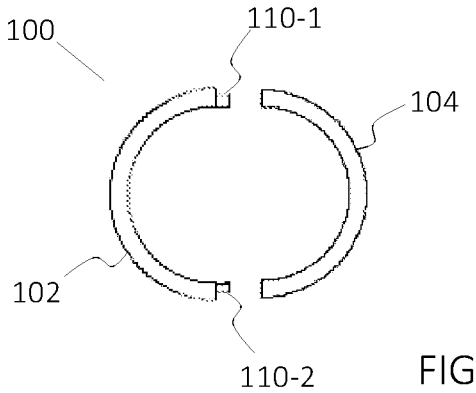
FIG. 15 is an exploded side view of a locking ring.
Figure 16:
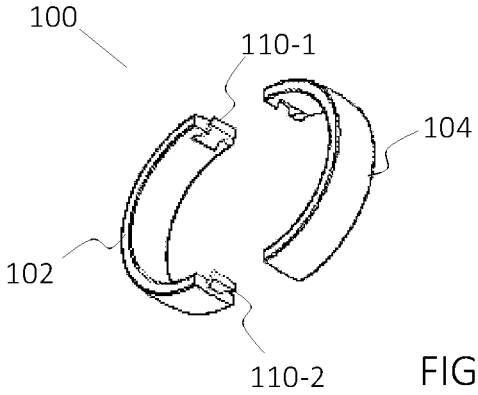
FIG. 16 is an exploded perspective view of a locking ring.
Figure 17:
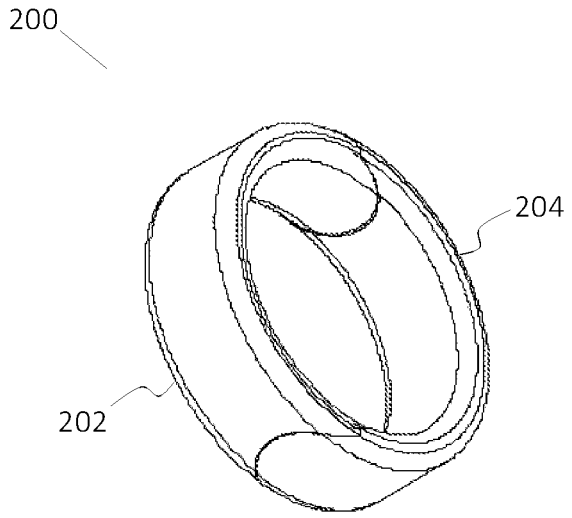
FIG. 17 is a perspective view of a locking ring.
Figure 18:
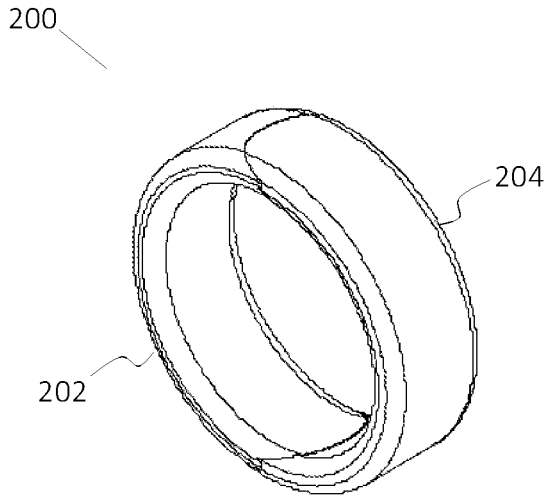
FIG. 18 is a perspective view of a locking ring.
Figure 19:
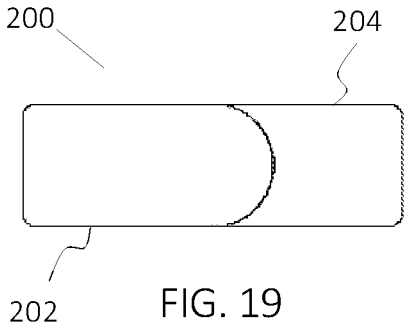
FIG. 19 is a top view of a locking ring.
Figure 20:
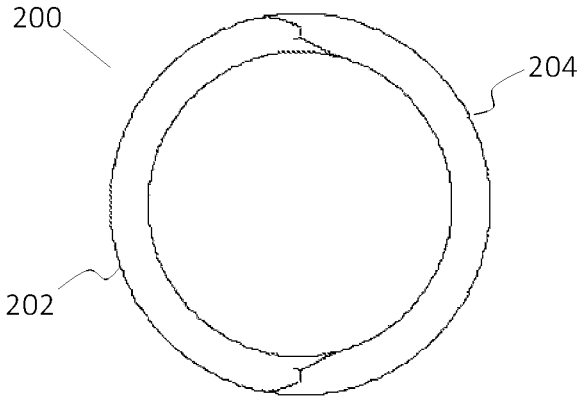
FIG. 20 is a side view of a locking ring.
Figure 21:
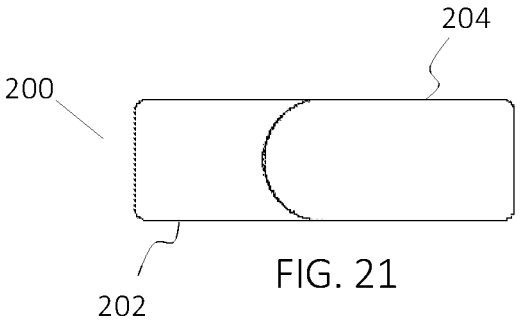
FIG. 21 is a bottom view of a locking ring.

FIG. 14 illustrates an exploded perspective view of the first 102 and second semi-annular band portions 104 with a key member 110-1, -2 present. Each key member 110-1, -2 is inserted into a respective cutout 108-1, 108-3 (see FIGS. 7, 9) on ends of each respective band portion 102, 104. FIG. 16 illustrates the exploded perspective view from another angle. FIG. 15 illustrates a side view of each first 102 and second semi-annular band 104 without a key member 110-1, -2.

A first half of the bowtie of the key member 110-1 is inserted into one of the cutouts 108-1, -3 on the end of the first semi-annular band portion. The second half of the bowtie 110-1 is inserted into one of the cutouts 108-2, -4 on the end of the second semi-annular band portion 104. The key member 110-1, -2 is curved so as to follow the contours and curvature of the first 102 and second semi-annular band portions 104. In other words, the radius of curvature of the key members 110-1, -2 is the same as the radius of curvature of the first 102 and second semi-annular band portions 104. The key member 110-1, -2 is to lay flush with the first 102 and second semi-annular band portions 104 such that an inner facing surface of the key member 110 and an inner facing surface of the first 102 and second semi-annular band portions 104 is smooth. Each key member 110-1, -2 may be molded separately before being inserted into the respective cutouts 108-1, -2, -3, -4. The cross-sectional area and shape of the key members 110-1, -2 may be adjusted based on the desired design and load resisting capacity.

Each end of the first and second band portions 102, 104 have a cutout 106-1, -2, -3, -4. Two key members 110-1, -2 secure the first and second band portions together when inserted within the respective cutouts 106-1, -2, -3, -4. The key members 110-1, -2 lay diametrically opposed along a circumferential perimeter of the first 102 and second band portions 104 when inserted within the cutouts 108-1, -2, -3, -4. In another example, the key members 110-1, -2 are adjacent to each other. For example, the key members 110-1, -2 may be at a 90 degree angle from each other along the circumferential perimeter of the ring 100 and with respect to a center of the ring 100.

The first 102 and second band portions 104 and key members 110-1, -2 may comprise a metal, plastic, or combination thereof. In an example, the material may be one or more of gold, silver, platinum, tungsten, or metal alloy. In an example, the material comprises one or more of plastic or metal or combination thereof. In another example, the material may include a polymer comprising plastic and rubber. In an example, the key members 110-1, -2 are made of different material than the first 102 and second band portions 104.

The key members 110-1, -2 may be attached to the first 102 and second band portions 104 by a friction fit, a bond material, applied heat, silver or tin alloy solder, or any material that is weaker than the key members 110-1, -2 or the first 102 and second band portions 104. In an example, the bond is a silicon based adhesive. The material may be weaker than both the key members 110-1, -2 and the first 102 and second band portions. In an example, the material is plastic. During use, the ring 100 may slide on a finger and receive normal wear and tear without the key members 110-1, -2 breaking.

The material of the key members 110-1, -2 is designed to break apart under a force. A threshold force that breaks the material may be less than a force that would break the material of the first and second band portions 102, 104. In an example, the tensile strength of the key members 110-1, -2 is less than the first 102 and second band portions 104. In another example, the shear strength of the key members 110-1, -2 is less than the first 102 and second band portions 104. In another example, the material of the key members 110-1, -2 will break at 18 lbs. In another example, the material will break at 18 lbs to 20 lbs, 20 lbs to 22 lbs, or 22 lbs to 24 lbs. The material may be designed to withstand a pressure that protects damage to fingers. In an example, each key member 110-1, -2 includes different properties such that a first key member 110-1 breaks before a second key member -2. The properties may be different in at least one of material, tensile strength, and shear strength.

Although the key member is shown in a bowtie shape, other shapes are anticipated, including polygons, diamond shape, a figure eight or infinity symbol, as well as other shapes.

Figure 22:
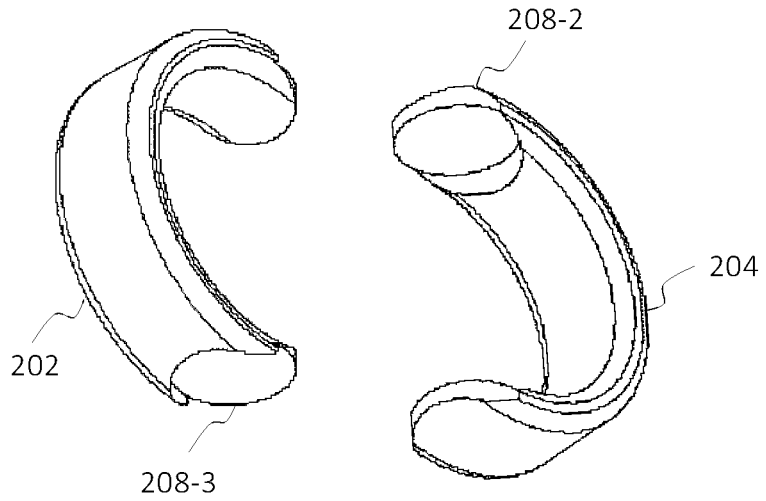
FIG. 22 is an exploded perspective view of a locking ring.
Figure 23:
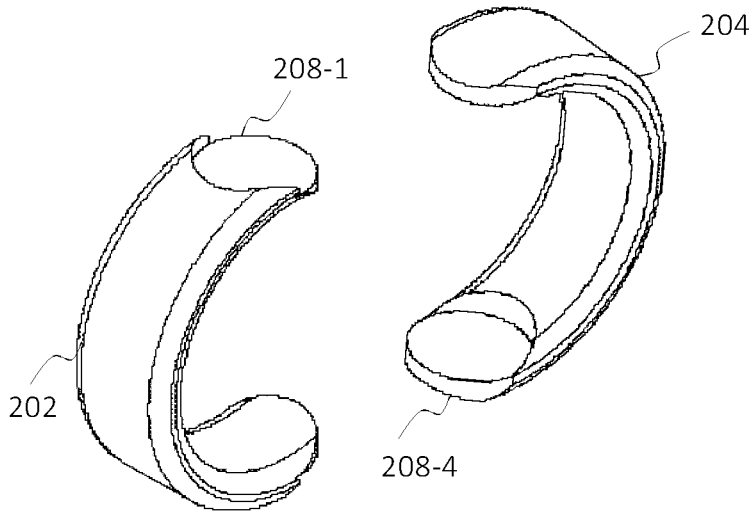
FIG. 23 is an exploded perspective view of a locking ring.

FIGS. 17, 18, 19, 20, 21 illustrate an example ring 200 in which the cutouts and key members are the same in structure and the ring configuration occurs by interlocking of the end of the band portions. FIG. 22 illustrates a perspective view which references cutouts 208-2, -3 and FIG. 23 illustrates another perspective view with cutouts 208-1, -4. The cutouts 208-1, -2, -3, -4 are also key members, and are defined as an extension of the first and second band portions 202 and 204. In other words, the cutouts 208-1, -2, -3, -4 are the key member and the cutout, securement being accomplished with end structures of the cutouts 208-1, -2, -3, -4 being attached together.

Particularly, each cutout 208-1, -2, -3, -4 includes a recessed indentation. One indentation starts from a bottom end surface while the corresponding indentation starts from a top end surface. Cutouts 208-1, -3 on band portion 202 include rounded indentations that have a consistent depth in the material of the band portion 202 starting from a top, or outer facing surface of the band portion 202. Cutouts 208-2, -4 on band portion 204 include rounded indentations that have a consistent depth in the material of the band portion 204 starting from a bottom, or inner facing surface of the band portion 204. Bottom facing cutouts 208-2, -4 slide over surfaces of top facing surfaces 208-1, -3 with a friction fit or otherwise smooth fit with surfaces being flush. A bond material, such as a silicon based adhesive is used to secure the two ends together.

Because the cutouts 208-1, -2, -3, -4 are thinner relative to the remainder of the band portions 202, 204, the cutouts 208-1, -2, -3, -4 will break apart before the rest of the band portions 202, 204.

The preceding description has been presented to illustrate and describe examples of the principles described. This description is not intended to be exhaustive or to limit these principles to any precise form disclosed. Many modifications and variations are possible in light of the above teaching.

What is claimed is:

1. A locking ring, comprising:

a first semi-annular band portion;

a second semi-annular band portion;

a first and second cutout on at least one end of the respective first and second semi-annular band portions; and a key member, the key member to be inserted within each of the first and second cutouts and thereby lock the first and second semi-annular band portions into a ring configuration forming a circular band to be worn on a finger, the key member to be released when the ring configuration is under a force to thereby allow the first and second semi-annular band portions to be unlocked:

wherein the key member includes a bowtie shape and the first and second cutouts of the first and second semi-annular band portions define a corresponding bowtie shape.

2. The locking ring in claim 1, wherein the cutout of the first and second semi-annular band portions has a same shape.

3. The locking ring in claim 1, wherein the cutout is symmetrical about a line that is perpendicular to a central axis of the circular band.

4. The locking ring in claim 1, wherein a first half of the bowtie is inserted into the cutout on the end of the first semi-annular band portion and the second half of the bowtie is inserted into the cutout on the end of the second semi-annular band portion.

5. The locking ring in claim 1, wherein the key member is curved so as to follow the contours and curvature of the first and second semi-annular band portions.

6. The locking ring in claim 1, wherein the first and second semi-annular band portions are of same dimension and size.

7. The locking ring in claim 1, wherein each end of the first and second semi-annular band portions have a cutout and two key members secure the first and second semi-annular band portions together when inserted within the cutouts.

8. The locking ring in claim 7, wherein the two key members are diametrically opposed along a circumferential perimeter of the first and second semi-annular band portions when inserted within the cutouts.

9. The locking ring in claim 1, wherein the key member is made of different material than the first and second semi-annular band portions.

10. The locking ring in claim 1, wherein the cutout extends at least partially within the first and second semi-annular band portions.

11. The locking ring in claim 1, wherein the key member is an extension of the first and second semi-annular band portions, the cutout having a same end structure and the key member being same in end structure, securement being accomplished with end structures being attached.

12. A locking ring, comprising:

a circular band configured to be worn on a finger with semi-annular band portions forming the circular band;

a cutout in an end of each of the semi-annular portions that extends at least partially within a depth of the band;

a key member, the key member to be inserted within the cutout, the key member to be released when the ring configuration experiences a threshold force;

wherein the key member includes a bowtie shape and the cutouts of the semi-annular band portions define a corresponding bowtie shape.

13. The locking ring in claim 12, wherein the key member comprises plastic.

14. The locking ring in claim 12, wherein ends of the cutout are wider than a central location of the cutout.

15. The locking ring in claim 12, further comprising a slit in the circular band that is located along a centerline that runs through the cutout and the key member and perpendicular to a central axis of the circular band.

16. The locking ring in claim 12, further comprising a cut therethrough in the circular band that is located along a centerline that runs through the cutout and the key member and perpendicular to a central axis of the circular band.

17. The locking ring in claim 12, wherein the cutout has a depth that is less than a length of the key member.

18. The locking ring in claim 12, wherein the circular band comprises at least one of gold, silver, platinum, and tungsten.

19. A locking ring, comprising:

a first semi-annular band portion;

a second semi-annular band portion that is symmetrical to the first semi-annular band portion;

a first and second cutout on each end of the respective first and second semi-annular band portions, contact and alignment of the first and second cutouts defining bowtie shapes when the first and second semi-annular band portions are secured to form a ring configuration, each bowtie shape located on diametrically opposing sides of the ring configuration; and a key member, the key member inserted within each of the cutouts to thereby lock the first and second semi-annular band portions into the ring configuration, the key member comprising a material that breaks under less force than the first and second semi-annular band portions, the force to thereby allow the first and second semi-annular band portions to be unlocked.

* * * * *